US009318061B2

(12) United States Patent
Chang et al.

(10) Patent No.: US 9,318,061 B2
(45) **Date of Patent: *Apr. 19, 2016**

(54) METHOD AND DEVICE FOR MAPPING INPUT GRAYSCALES INTO OUTPUT LUMINANCE

(71) Applicant: NOVATEK Microelectronics Corp., Hsin-Chu (TW)

(72) Inventors: Yu-Pin Chang, Hsinchu County (TW); Kai-I Dai, Taoyuan County (TW); Jie-Jung Huang, Miaoli County (TW); Yu-Hsing Chuang, Hsinchu (TW); Shih-Hung Huang, Hsinchu County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/332,378

(22) Filed: Jul. 15, 2014

(65) Prior Publication Data

US 2016/0019849 A1 Jan. 21, 2016

(51) Int. Cl.
*G09G 3/36* (2006.01)
*G09G 5/10* (2006.01)

(52) U.S. Cl.
CPC ..... *G09G 3/3607* (2013.01); *G09G 5/10* (2013.01); *G09G 2310/0272* (2013.01); *G09G 2320/0626* (2013.01); *G09G 2320/0646* (2013.01)

(58) Field of Classification Search
CPC ..... G09G 2320/0276; G09G 2320/0285; G09G 2360/141
See application file for complete search history.

(56) References Cited

U.S. PATENT DOCUMENTS

| | | | | |
|---|---|---|---|---|
| 6,115,092 | A * | 9/2000 | Greene et al. | 349/74 |
| 2007/0273686 | A1 * | 11/2007 | Watanabe et al. | 345/419 |
| 2007/0285576 | A1 * | 12/2007 | Moore et al. | 348/674 |
| 2010/0156956 | A1 * | 6/2010 | Madden et al. | 345/690 |
| 2010/0195901 | A1 * | 8/2010 | Andrus et al. | 382/162 |
| 2013/0135272 | A1 * | 5/2013 | Park | 345/211 |

* cited by examiner

*Primary Examiner* — Ricardo L Osorio
(74) *Attorney, Agent, or Firm* — Winston Hsu; Scott Margo

(57) ABSTRACT

A method for mapping an input grayscale into an output luminance includes selecting a first reference grayscale, a first reference luminance, a second reference grayscale and a second reference luminance according to an input grayscale, generating a middle reference grayscale and a middle luminance, replacing a value of the first or second reference grayscale by a value of the middle reference grayscale, and replacing a value of the first or second reference luminance by a value of the middle luminance according to the middle reference grayscale and the input grayscale, and generating an output luminance by computing a linear transformation equation.

22 Claims, 10 Drawing Sheets

METHOD AND DEVICE FOR MAPPING INPUT GRAYSCALES INTO OUTPUT LUMINANCE

BACKGROUND OF THE INVENTION

1. Field of the Invention

The present invention relates to a method and device for mapping input grayscales into output luminance, and more particularly, to a method and device for mapping input grayscales into output luminance by computing a linear transformation equation.

2. Description of the Prior Art

In n-bit color depth display devices, each pixel of the display device has 2^n grayscales, each of which corresponds to a specific voltage level. In other words, various degrees of bright/dark visual performances are achieved by driving each pixel with 2^n distinct voltage levels.

Please refer to FIG. 1, which illustrates an ideal gamma curve for mapping input grayscales into distinct voltage levels, respectively. Take an 8-bit color depth display device for example, there are grayscales 1 to 254 corresponding to distinct 254 voltage levels for the ideal gamma curve, wherein grayscales 0 and 255 are respectively pure dark and pure white.

Traditionally, there are two methods for mapping the input grayscales into distinct voltage levels to perform bright/dark visual performances based on analog or digital operating environment.

For analog operating environment, a gamma voltage generator is composed of a plurality of series of resistors for generating distinct voltage levels. Under control of a logic device, the gamma voltage generator generates the specific gamma voltage corresponding to the input grayscale. However, resistances of the resistors are fixed once the gamma voltage generator is produced, which is customized only for one display model.

For digital operating environment, a pair of one grayscale and the corresponding voltage level forms a point or coordinate of the gamma curve shown in FIG. 1. Information of 254 points of the gamma curve for the 8-bit color depth display device is stored in a lookup table device of the display device, such that the display device is able to generate distinct voltage levels according to contents of the lookup table device. Contents of the lookup table device, e.g. one time programmable (OTP) memory, can be modified and customized for various display models, which is beneficial for mass production for various display models.

However, in practice, there is a limited number N of pinch points, instead of all the 254 points, stored in the lookup table device to save a hardware area of the lookup table device so as to save a production cost of the display device. The gamma voltages corresponding to the points other than the limited number N of pinch points are generated by computing a linear transformation equation for approximating the ideal gamma curve.

For example, any two of nearby pinch points determine a linear transformation equation, and a gamma voltage corresponding to an input grayscale between the nearby pinch points can be generated by performing a linear interpolation on the linear transformation equation. However, the ideal gamma curve shown in FIG. 1 is a nonlinear curve, and thus there is an approximation error when using the linear transformation equation to approximate the nonlinear gamma curve, which may cause unsmooth grayscale representation on the display device to be sensed by human vision.

In order to avoid unsmooth grayscale representation from the display device and improve a display quality of the display device, as many as pinch points are required, a greater hardware area of the lookup table device and a higher production cost of the display device are also required. In other words, there is a dilemma between the display quality and the production cost, i.e. smooth grayscale representation and the hardware area of the lookup table unit, based on a traditional mapping scheme for mapping the input grayscales into corresponding voltage levels, i.e. the linear interpolation to the linear transformation equation for approximating the nonlinear gamma curve.

Therefore, there is a need to improve the prior art.

SUMMARY OF THE INVENTION

It is therefore an objective of the present invention to provide a method and device for mapping input grayscales into corresponding voltage levels by computing a linear transformation equation.

The present invention discloses a method for mapping an input grayscale into an output luminance includes selecting a first reference grayscale, a first reference luminance, a second reference grayscale and a second reference luminance according to an input grayscale; generating a middle reference grayscale and a middle luminance by computing first and second equations of: X_MID=(X1+X2)/2; and Y_MID=(Y1+Y2)/2±Δ, wherein A denotes an offset, X1 denotes the first reference grayscale, X2 denotes the second reference grayscale, Y1 denotes the first reference luminance, Y2 denotes the second reference luminance, X_MID denotes the middle reference grayscale, and the Y_MID denotes the middle luminance; replacing a value of the first or second reference grayscale by a value of the middle reference grayscale, and replacing a value of the first or second reference luminance by a value of the middle luminance according to the middle reference grayscale and the input grayscale; and generating an output luminance by computing a third equation of:

$$Y=Y1+(Y2-Y1)/(X2-X1)*(X-X1),$$

wherein Y denotes the output luminance.

The present invention further discloses a device for mapping an input grayscale into an output luminance includes a lookup table unit, for storing a plurality of reference grayscales corresponding to a plurality of reference luminance, respectively; and a logic unit, coupled to the lookup table unit, for selecting a first reference grayscale, a first reference luminance, a second reference grayscale and a second reference luminance according to an input grayscale to generate a middle reference grayscale and a middle luminance by computing first and second equations of: X_MID=(X1+X2)/2; and Y_MID=(Y1+Y2)/2+Δ, wherein Δ denotes an offset, X1 denotes the first reference grayscale, X2 denotes the second reference grayscale, Y1 denotes the first reference luminance, Y2 denotes the second reference luminance, X_MID denotes the middle reference grayscale, and the Y_MID denotes the middle luminance; replacing a value of the first or second reference grayscale by a value of the middle reference grayscale; and replacing a value of the first or second reference luminance by a value of the middle luminance according to the middle reference grayscale and the input grayscale to generate an output luminance by computing a third equation of: Y=Y1+(Y2−Y1)/(X2−X1)*(X−X1), wherein Y denotes the output luminance.

The present invention further discloses a method for mapping an input grayscale into an output luminance includes selecting a first reference grayscale, a first reference luminance, a second reference grayscale and a second reference luminance according to an input grayscale; and generating an output luminance by computing a first equation of: $Y=Y1+(Y2-Y1)/(X2-X1)*(X-X1)$, wherein Y denotes the output luminance, X1 denotes the first reference grayscale, X2 denotes the second reference grayscale, Y1 denotes the first reference luminance, Y2 denotes the second reference luminance, X_MID denotes the middle reference grayscale, and the Y_MID denotes the middle luminance; and generating a compensated luminance according to the output luminance, at least one slope compensating values, and the input grayscale, wherein the compensated luminance is generated by computing a second equation of: Y_CP=Y+Y_OFS, wherein Y_CP denotes the compensated luminance, and Y_OFS denotes an offset luminance.

The present invention further discloses a device for mapping an input grayscale into an output luminance includes a lookup table unit, for storing a plurality of reference grayscales corresponding to a plurality of reference luminance, and a plurality of slope compensating values; a logic unit, coupled to the lookup table unit for selecting a first reference grayscale, a first reference luminance, a second reference grayscale and a second reference luminance according to an input grayscale to generate an output luminance by computing a first equation of: $Y=Y1+(Y2-Y1)/(X2-X1)*(X-X1)$, wherein Y denotes the output luminance, X1 denotes the first reference grayscale, X2 denotes the second reference grayscale, Y1 denotes the first reference luminance, Y2 denotes the second reference luminance, X_MID denotes the middle reference grayscale, and the Y_MID denotes the middle luminance; and a compensating unit, coupled to the logic unit and the lookup table unit, for generating a compensated luminance according to the output luminance, at least one slope compensating values, and the input grayscale, wherein the compensated luminance is generated by computing a second equation of: Y_CP=Y+Y_OFS, wherein Y_CP denotes the compensated luminance, and Y_OFS denotes an offset luminance.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
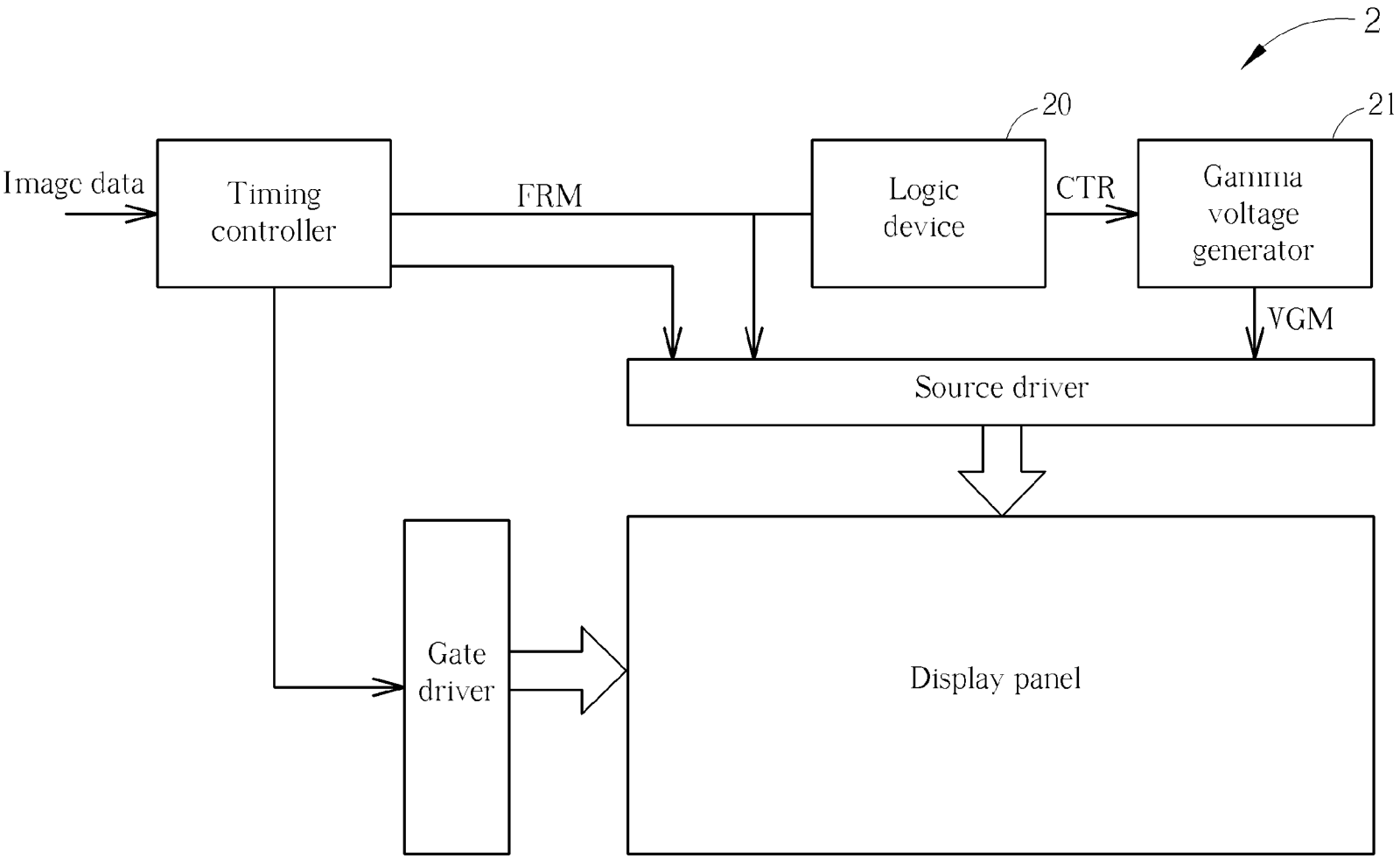
FIG. 2 is a schematic diagram of a liquid crystal display device 2.

Please refer to FIG. 2, which is a schematic diagram of a display device 2. The display device 2 includes a display panel, a source driver, a gate driver, a timing controller, a logic device 20 and a gamma voltage generator 21. The display panel, the source driver, the gate driver, and the timing controller of the display device 2 are fundamental components of the display device 2, of which the operating principles are well known in the art. The logic device 20 and the gamma voltage generator 21 cooperate to control bright/dark visual performances of the display device 2, and may be combined as a driving device or be integrated into the timing controller, which is not limited herein.

The logic device 20 generates a control signal CTR according to a frame signal FRM, wherein the frame signal FRM indicates an input grayscale X (which may be an 8-bit encoded digital signal) corresponding to a specific voltage level. The gamma voltage generator 21 generates a gamma voltage VGM to the source driver of the display device 2 according to the control signal CTR, wherein the control signal CTR indicates an output luminance Y (which may be a 10-bit encoded digital signal) corresponding to the grayscale X. In other words, the input grayscale X is mapped into the output luminance Y by the logic device 20 such that the gamma voltage generator 21 generates the gamma voltage VGM according to the output luminance Y indicated by the control signal CTR. As a result, the display panel may be driven to display images of the frame signal FRM.

Figure 3:
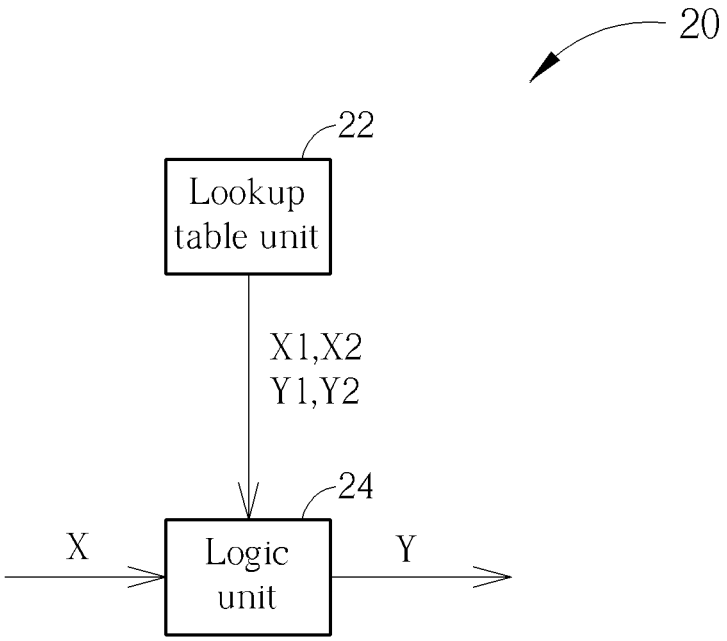
FIG. 3 is a schematic diagram of the logic device shown in FIG. 2 according to a first embodiment of the present invention.

Please refer to FIG. 3, which is a schematic diagram of the logic device 20 shown in FIG. 2 for mapping the input grayscale X into the corresponding output luminance Y according to a first embodiment of the present invention. The logic device 20 includes a lookup table unit 22 and a logic unit 24. The lookup table unit is used for storing a plurality of reference grayscales corresponding to a plurality of reference luminance, respectively.

The logic unit 24 is coupled to the lookup table unit 22 for selecting reference grayscales X1 and X2, and reference luminance Y1 and Y2 from the plurality of reference grayscales and the plurality of reference luminance according to the input grayscale X indicated by the frame signal FRM. The logic unit 24 then generates the output luminance Y according to the input grayscale X, the reference grayscales X1 and X2 and the reference luminance Y1 and Y2.

Figure 1:
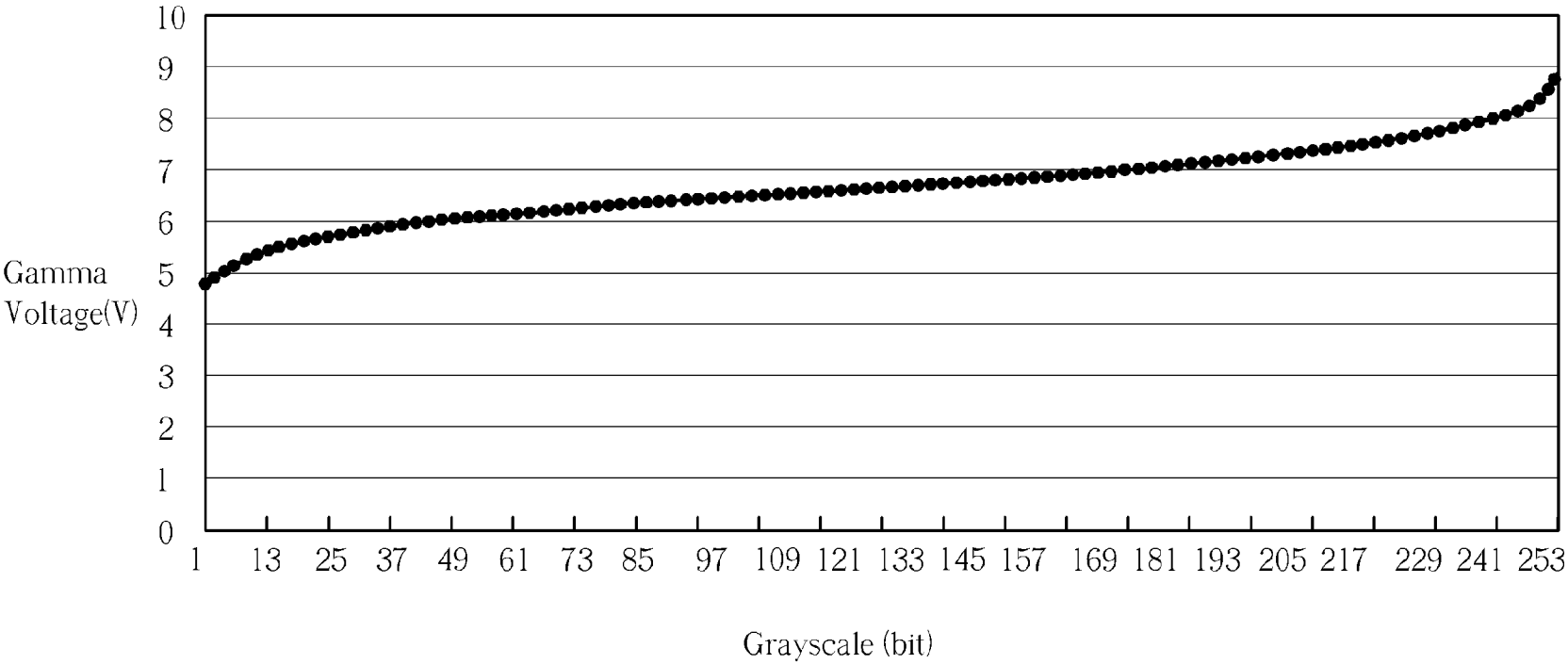
FIG. 1 PRIOR ART
FIG. 1 illustrates a gamma curve for mapping input grayscales into distinct voltage levels, respectively.
Figure 4:
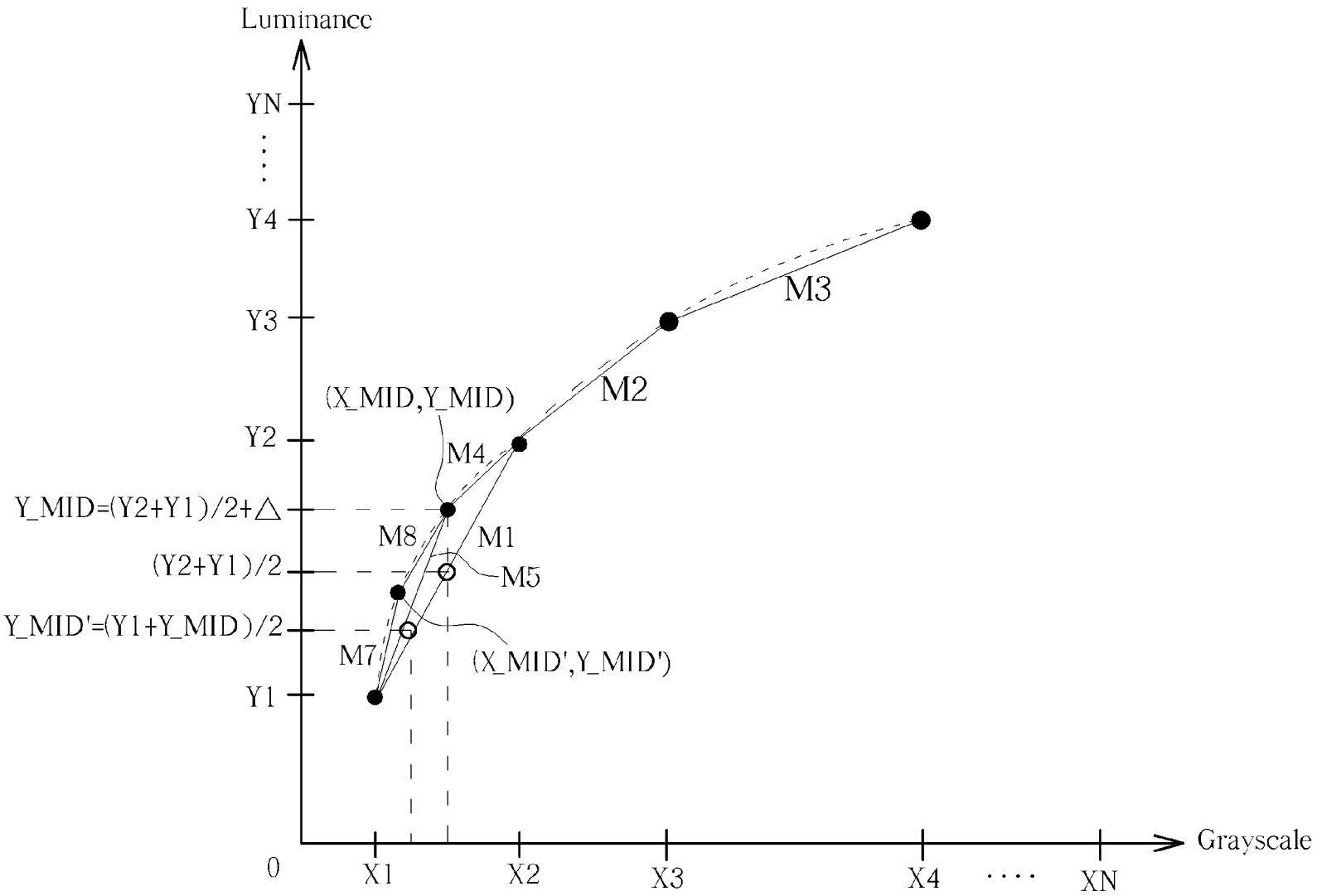
FIG. 4 illustrates a segment of the gamma curve shown in FIG. 1.

In detail, please refer to FIG. 4, which illustrates a segment of the gamma curve shown in FIG. 1, wherein the plurality reference grayscales are denoted with X1–XN, the reference luminance are denoted with Y1–YN, and N is the number of pinch points stored in the lookup table unit 22. A pair of one reference grayscale and one reference luminance forms a pinch point (i.e. a coordinate) of the gamma curve, and there are four pinch points (X1,Y1), (X2,Y2), (X3,Y3) and (X4, Y4) illustrated in FIG. 4 for example, which is not limited.

In practice, unsmooth grayscale representation is sensed by human vision if a variation between nearby pinch points is too big, and such a situation can be detected by checking whether the variation between the nearby pinch points is greater than a threshold.

In order to save hardware area and avoid unsmooth grayscale representation, under the limited number N of pinch points, the logic device 20 of the present invention is capable of automatically generating extra pinch points between any two nearby pinch points when unsmooth grayscale representation is detected, such that a variation between the extra pinch point and one of the two nearby pinch points is small enough to avoid unsmooth grayscale representation.

Figure 5:
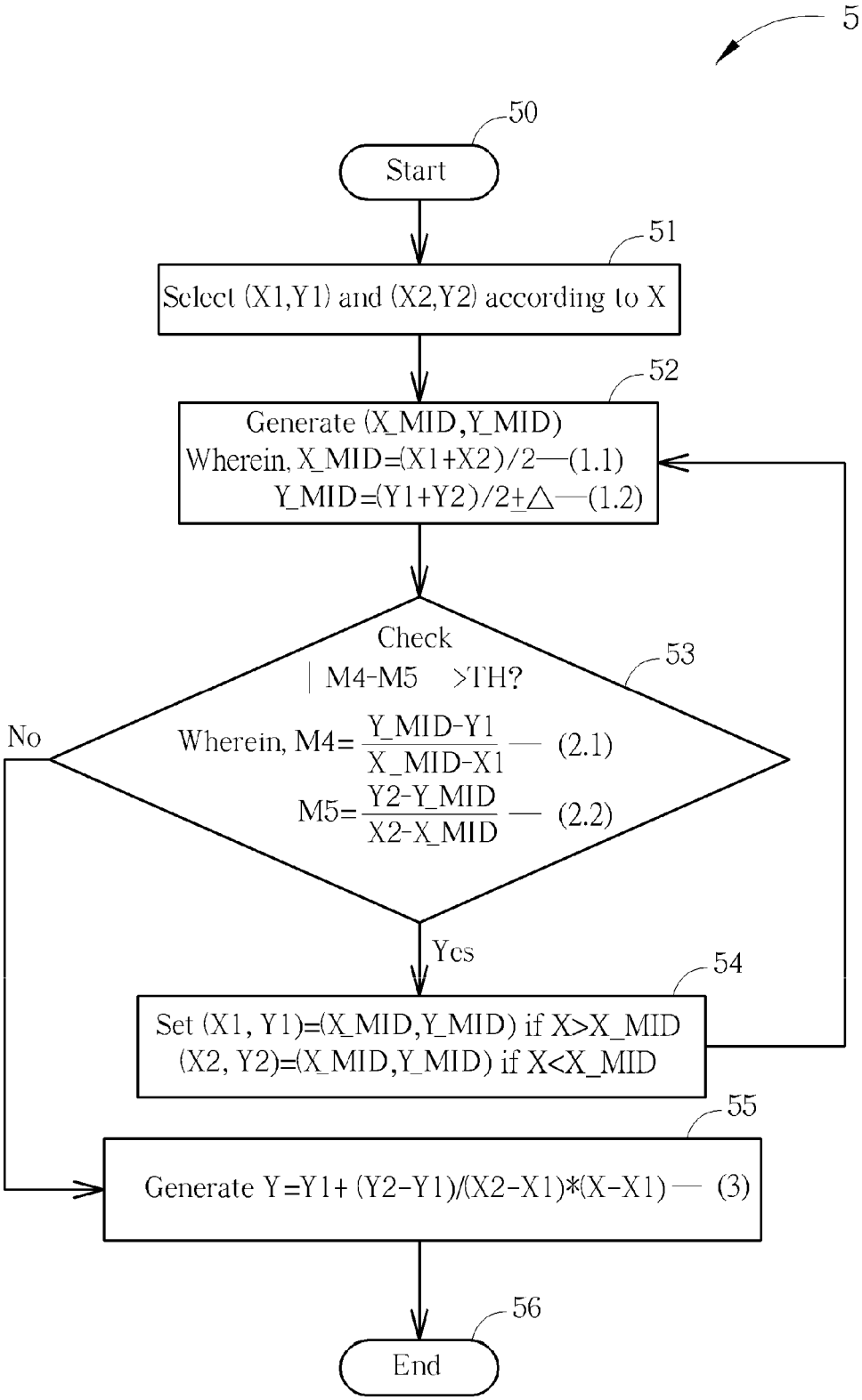
FIG. 5 is a schematic diagram of a process according to the first embodiment of the present invention.

Specifically, please refer to FIG. 4 and FIG. 5 at the same time. FIG. 5 illustrates a flowchart of a process 5 for mapping the input grayscale X into the corresponding output luminance Y according to the first embodiment of the present invention. The process 5 describes a mapping scheme of the logic device 20 and includes the following steps:

Step 50: Start.

Step 51: Select the pinch points (X1,Y1) and (X2,Y2) according to the input grayscale X.

Step 52: Generate a middle point (X_MID,Y_MID) of the pinch points (X1,Y1) and (X2,Y2).

Step 53: Check whether an absolute difference between a slope M4 of the middle point (X_MID,Y_MID) and the pinch point (X1,Y1) and the a slope M5 of the middle point (X_MID,Y_MID) and the pinch point (X2,Y2) is greater than a threshold TH. Go to Step 54 if yes; go to Step 55 if no.

Step 54: Replace one of the pinch points (X1,Y1) and (X2,Y2) by the middle point (X_MID,Y_MID) according to the input grayscale X and the middle grayscale X_MID. Return to Step 52.

Step 55: Generate the out output luminance Y according to the pinch points (X1,Y1) and (X2,Y2) and the input grayscale X.

Step 56: End.

In Step 51, the logic unit 24 selects two nearby pinch points (X1,Y1) and (X2,Y2) according to the input grayscale X from the lookup table unit 22, wherein the input grayscale X lies within an interval between the two nearby reference grayscales X1 and X2. Please note that the two nearby pinch points (X1,Y1) and (X2,Y2) selected by the logic unit 24 may be representative of any two nearby pinch points (X2,Y2) and (X3,Y3) or (X3,Y3) and (X4,Y4) if the input grayscale X lies within an interval between the two nearby reference grayscales X2 and X3 or an interval between the two nearby reference grayscales X3 and X4, respectively.

In Step 52, the logic unit 24 generates an extra pinch point by generating a middle point between the pinch points (X1, Y1) and (X2,Y2), wherein the logic unit 24 generates a middle reference grayscale X_MID and a middle luminance Y_MID according to equations (1.1) and (1.2) as follows:

$$X_\mathrm{MID}=(X1+X2)/2 \tag{1.1}$$

$$Y_\mathrm{MID}=(Y1+Y2)/2\pm\Delta \tag{1.2}$$

Wherein, Δ denotes an offset, and the middle point (X_MID,Y_MID) is regarded as the extra pinch point. In other words, the logic unit 24 generates the middle point (X_MID,Y_MID) of the two nearby pinch points (X1,Y1) and (X2,Y2) as the extra pinch point.

In Step 53, the logic unit 24 detects unsmooth grayscale representation by checking whether the variation between the nearby pinch points is greater than the threshold TH, wherein the variation is an absolute difference between two nearby slopes M4 and M5, i.e. the logic unit 24 checks whether the condition |M4−M5|>TH is satisfied, wherein the logic unit 24 generates the slopes M4 and M5 according to equations (2.1) and (2.2) as follows:

$$M4=(Y_\mathrm{MID}-Y1)/(X_\mathrm{MID}-X1) \tag{2.1}$$

$$M5=(Y2-Y_\mathrm{MID})/(X2-X_\mathrm{MID}) \tag{2.2}$$

If the condition |M4−M5|>TH is satisfied, i.e. unsmooth grayscale representation is detected by the logic unit 24, the logic unit 24 performs Step 54 to replace one of the pinch points (X1,Y1) and (X2,Y2) by the middle point (X_MID, Y_MID). In detail, a value of the reference grayscale X1 is replaced by a value of the middle reference grayscale X_MID and a value of the reference luminance Y1 is replaced by a value of the middle luminance Y_MID if the input grayscale X is greater than the middle reference grayscale X_MID; or, a value of the reference grayscale X2 is replaced by the value of the middle reference grayscale X_MID and a value of the reference luminance Y2 is replaced by the value of the middle luminance Y_MID if the input grayscale X is smaller than the middle reference grayscale X_MID.

In other words, the pinch point (X1,Y1) is replaced by the middle point (X_MID,Y_MID) if the input grayscale X lies within an interval between the reference grayscale X2 and the middle reference grayscale X_MID; or, the pinch point (X2, Y2) is replaced by the middle point (X_MID,Y_MID) if the input grayscale X lies within an interval between the reference grayscale X1 and the middle reference grayscale X_MID.

The logic unit 24 returns to perform Step 52 again to generate another extra pinch point (X_MID',Y_MID') by generating another middle point of the pinch points (X1,Y1) and the middle point (X_MID,Y_MID). For example, it is assumed that the input grayscale X is smaller than the middle reference grayscale X_MID in the embodiment shown in FIG. 4, and the values of the pinch point (X2,Y2) are replaced by the values of the middle point (X_MID,Y_MID) in the equations (1.1) and (1.2) of Step 52.

The logic unit 24 performs Step 53 again to generate another slopes M7 and M8 according to the middle point (X_MID,Y_MID) and (X_MID',Y_MID') and the pinch point (X1,Y1) so as to detect unsmooth grayscale representation again by checking check whether an absolute difference between the slopes M7 and M8 is greater than the threshold TH, i.e. a condition |M7−M8|>TH, wherein values of the slopes M4 and M5 are replaced by values of the M7 and M8 in the equations (2.1) and (2.2) of Step 53.

Iteratively, the logic unit 24 performs Step 52 to Step 54 for generating extra pinch points and detecting unsmooth grayscale representation until the variation between the nearby pinch points is smaller than the threshold TH.

In Step 55, once unsmooth grayscale representation is not detected and final values of the pinch points (X1,Y1) and (X2,Y2) are determined, the logic unit 24 generates the output luminance Y by computing an equation (3) as follows:

$$Y=Y1+(Y2-Y1)/(X2-X1)*(X-X1) \tag{3}$$

Please note that the logic unit 24 is defaulted to automatically generate the middle pinch point of firstly selected pinch points without detecting unsmooth grayscale representation, i.e. the logic unit 24 performs Step 52 prior to Step 53. During a developing phase of the logic device 20, a designer may determine numeric values of the plurality of pinch points (X1,Y1) to (XN,YN), such that the variation between any two nearby pinch points can be designed to be greater than the threshold TH. In such a situation, it is unnecessary to detect unsmooth grayscale representation before the middle pinch point is generated, and the number N of the pinch points can be minimized because the more extra pinch points are generated, the less pinch points stored in the lookup table unit 22 are required, which also minimizes the hardware area of the lookup table unit 22.

In short, the logic device 20 of the present invention is capable of automatically and iteratively generating extra pinch points between any two nearby pinch points when unsmooth grayscale representation is detected, such that the variation between the extra pinch point and the pinch points, or any two nearby points, is ensured to be small enough to avoid unsmooth grayscale representation. Moreover, by automatically generating extra pinch points, the hardware area of the lookup table unit 22 can be saved to reduce production cost of the display device 2. In addition, for another embodiment, the logic unit 24 may perform Step 53 prior than Step 52 to generate the middle pinch point of firstly selected pinch points after detecting unsmooth grayscale representation.

Figure 6:
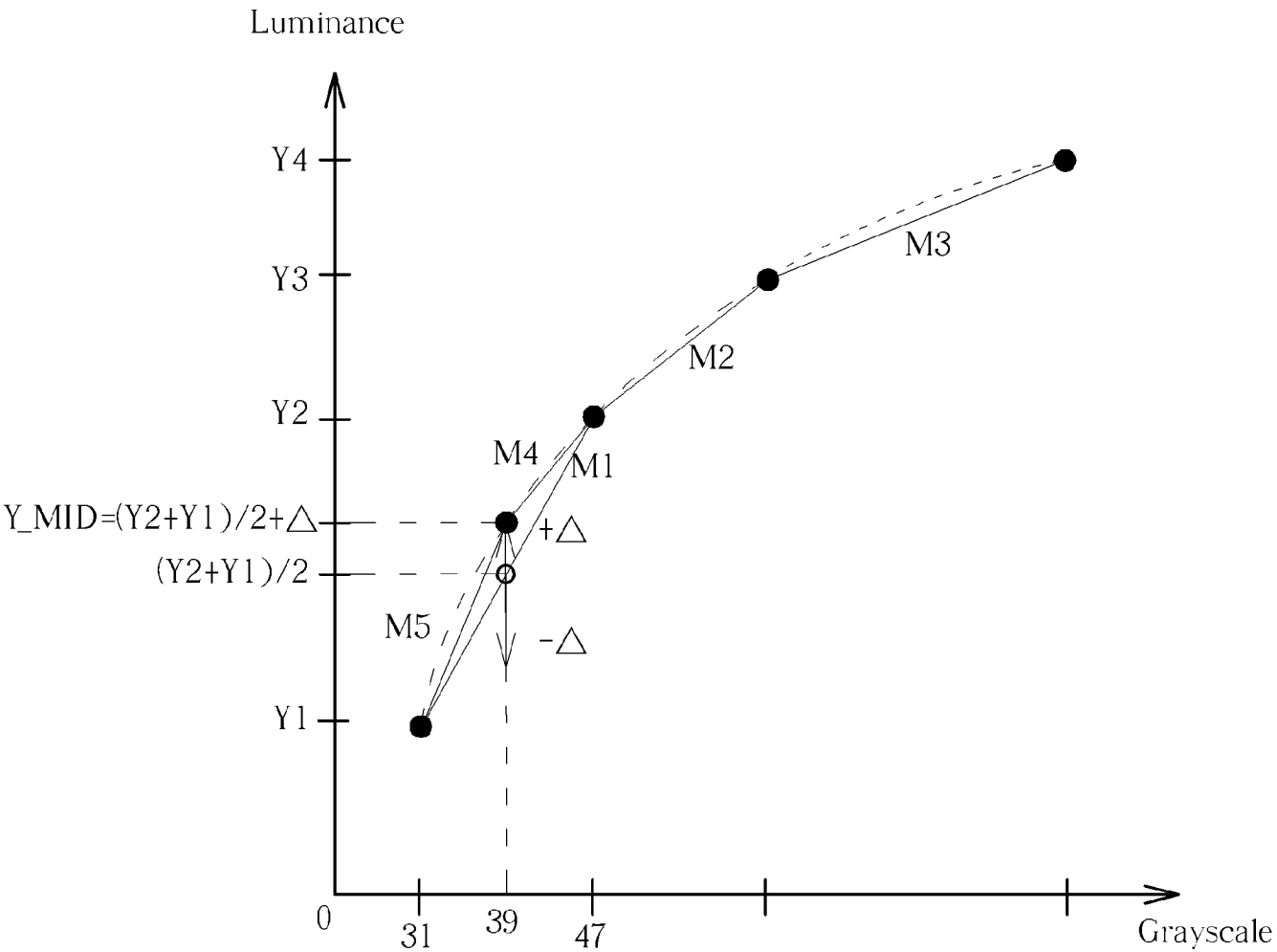
FIG. 6 illustrates a numerical example of the gamma curve shown in FIG. 4.

Please refer to FIG. 6, which illustrates a numerical example of the gamma curve shown in FIG. 4. In FIG. 6, it is assumed that the input grayscale X lies within an interval between the reference grayscale (X1=31) and the reference grayscale (X2=47). The logic unit 24 generates the middle reference grayscale X_MID and the middle luminance Y_MID as follows:

$$X_MID=(31+47)/2=39$$

$$Y_MID=(Y1+Y2)/2\pm\Delta$$

In one case, if the input grayscale X is smaller than the middle reference grayscale (X_MID=39), the value of the reference grayscale (X2=47) is replaced by the value of middle reference grayscale X_MID, i.e. X2=X_MID=39, and the value of the reference luminance Y2 is replaced by the value of middle reference luminance Y_MID, i.e.

$Y2=Y_MID$, and the output luminance $Y$ is generated by:

$$Y=Y1+(Y_MID-Y1)/(39-31)*(X-31)$$

In another case, if the input grayscale X is greater than the middle reference grayscale (X_MID=39), the value of the reference grayscale (X1=31) is replaced by the value of middle reference grayscale X_MID, i.e. X1=X_MID=39, and the value of the reference luminance Y1 is replaced by the value of middle reference luminance Y_MID, i.e. Y1=Y_MID, and the output luminance Y is generated by: Y=Y_MID+(Y2−Y_MID)/(47−39)*(X−39)

Figure 7:
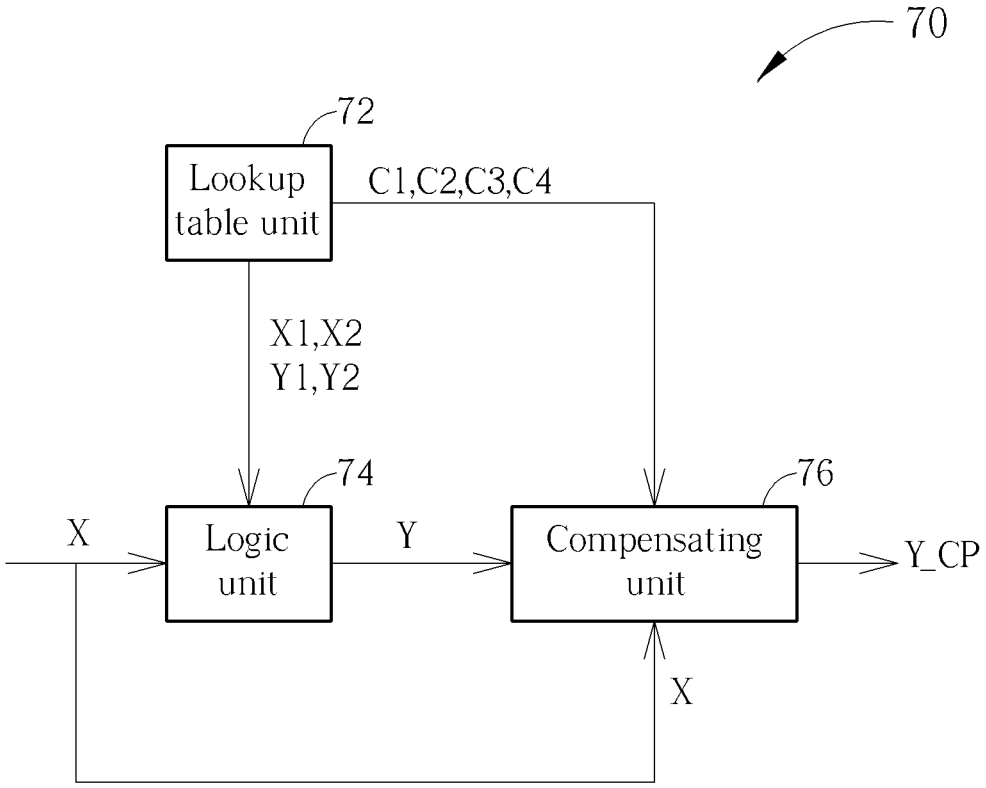
FIG. 7 is a schematic diagram of a logic device according to a second embodiment of the present invention.

Please refer to FIG. 7, which is a schematic diagram of a logic device 70 according to a second embodiment of the present invention. The logic device 70 can take place of the logic device 20 shown in FIG. 2, and includes a lookup table unit 72, a logic unit 74 and a compensating unit 76. The lookup table unit 72 is used for storing the plurality of pinch points (X1, Y1) to (XN,YN) and a plurality of slope compensating values.

The logic unit 74 is coupled to the lookup table unit 72 for selecting the reference grayscales X1 and X2, and the reference luminance Y1 and Y2 from the plurality of reference grayscales and the plurality of reference luminance according to the input grayscale X indicated by the frame signal FRM. The logic unit 74 then generates the output luminance Y according to the input grayscale X, the reference grayscales X1 and X2 and the reference luminance Y1 and Y2. The compensating unit 76 is coupled to the logic unit 74 and the lookup table unit 72 for generating a compensated luminance Y_CP according to the output luminance Y, at least one slope compensating values C1, C2, C3, and/or C4 and the input grayscale X.

Figure 8:
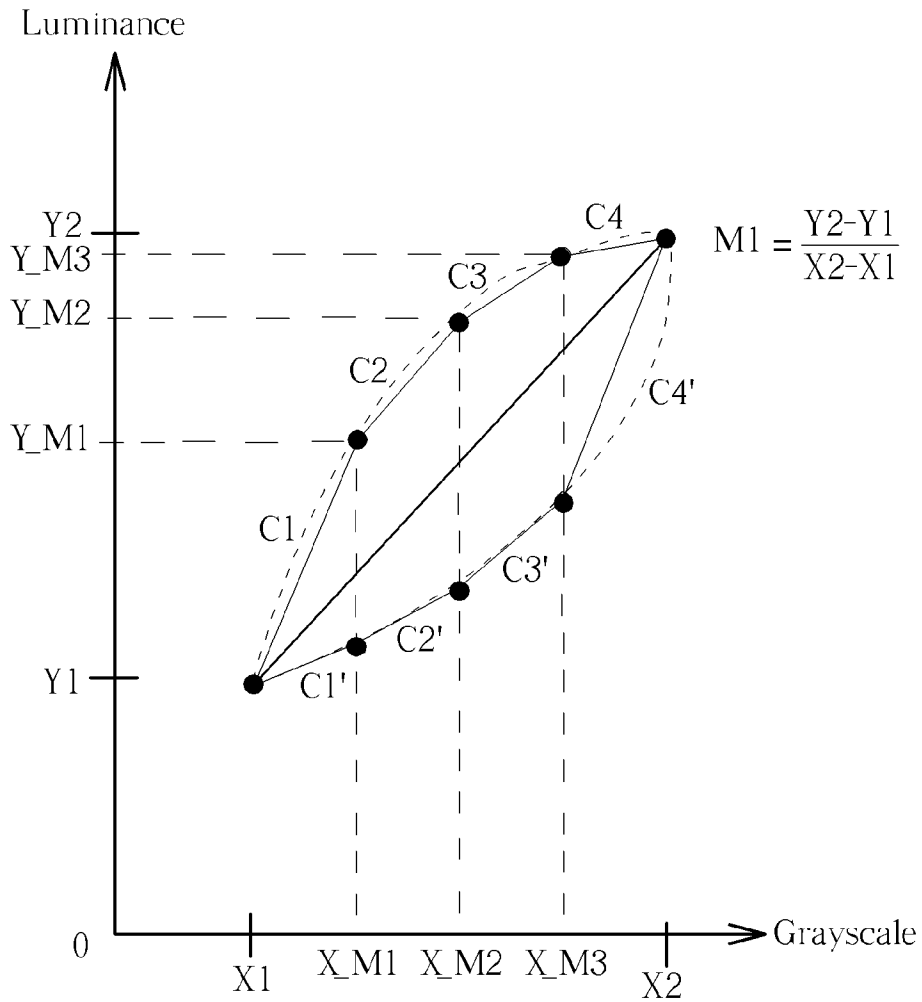
FIG. 8 illustrates a segment of the gamma curve shown in FIG. 1.

In detail, please refer to FIG. 8, which illustrates a segment of the gamma curve shown in FIG. 1 within the interval between the reference grayscales X1 and X2. Please note that the segment of the gamma curve may be representative of any segments of the gamma curve if the input grayscale X lies within the interval between the reference grayscales X2 and X3 or the interval between the reference grayscales X3 and X4, respectively. Further, the segment is equally divided into a plurality of sub-segments, and each of the sub-segments is corresponding to one of the plurality of slope compensating values C1, C2, C3 and C4, wherein the segment can be equally divided into even umbers of sub-segments, which determines a precision for approximating the ideal gamma curve.

In this embodiment, the gamma curve is equally divided into four sub-segments, and the interval between the reference grayscales X1 and X2 is equally divided by middle reference grayscales X_M1, X_M2 and X_M3. A pair of one middle reference grayscale X_M1, X_M2 or X_M3 and one middle reference luminance Y_M1, Y_M2 or Y_M3 forms a middle point (i.e. a coordinate) of the segment of the gamma curve, and there are three middle points (X_M1, Y_M1), (X_M2, Y_M2) and (X_M3, Y_M3) illustrated in FIG. 8 for example, which is not limited.

Preferably, differences between any two of the reference grayscales X1 and X2 and the middle reference grayscales X_M1, X_M2 and X_M3 are divisible by two. In practice, the grayscales X1, X2, X_M1, X_M2 and X_M3 are digital signals in a form of binary bits, since the differences between any two of the grayscales X1, X2, X_M1, X_M2 and X_M3 are divisible by two, a value of any grayscale can be obtained by shifting a value of another grayscale, which simplifies a circuit design of the compensating unit 76. For example, the compensating unit 76 performs a shift operation to the grayscale X1 or X2 to obtain values of the middle reference grayscales X_M1, X_M2 and X_M3.

Noticeably, a sum of the slope compensating values is equal to zero, i.e. C1+C2+C3+C4=0. For example, values of the slope compensating values C1, C2, C3 and C4 can be but not limited to positive or negative one for simplicity. The values of the slope compensating values C1, C2, C3 and C4 is determined according to whether a slope between two nearby points is greater or smaller than the slope M1 of the pinch points (X1, Y1) and (X2,Y2). For example, as shown in FIG. 8, since a slope of the pinch point (X1, Y1) and the middle point (X_M1, Y_M1) is greater than the slope M1, the corresponding slope compensating values C1 is chosen to be positive one, and the same as the slope compensating values C2 is chosen to be positive one. On the other hand, since a slope of the middle points (X_M2, Y_M2) and (X_M3, Y_M3) is smaller than the slope M1, the corresponding slope compensating values C3 is chosen to be negative one, and the same as the slope compensating values C4 is chosen to be negative one.

FIG. 8 also illustrates another segment of the gamma curve, wherein values of slope compensating values C1', C2', C3' and C4' are respectively negative one, negative one, positive one and positive one according to the slope between two nearby points is greater or smaller than the slope M1 of the pinch points (X1,Y1) and (X2,Y2).

In order to save hardware area and avoid unsmooth grayscale representation, under the limited number N of pinch points, the logic device 70 of the present invention is capable of compensating the output luminance Y to generate the compensated luminance Y_CP, which reduces an approximation error when using the linear transformation equation (3) to approximate the ideal gamma curve and avoids unsmooth grayscale representation as well.

Figure 9:
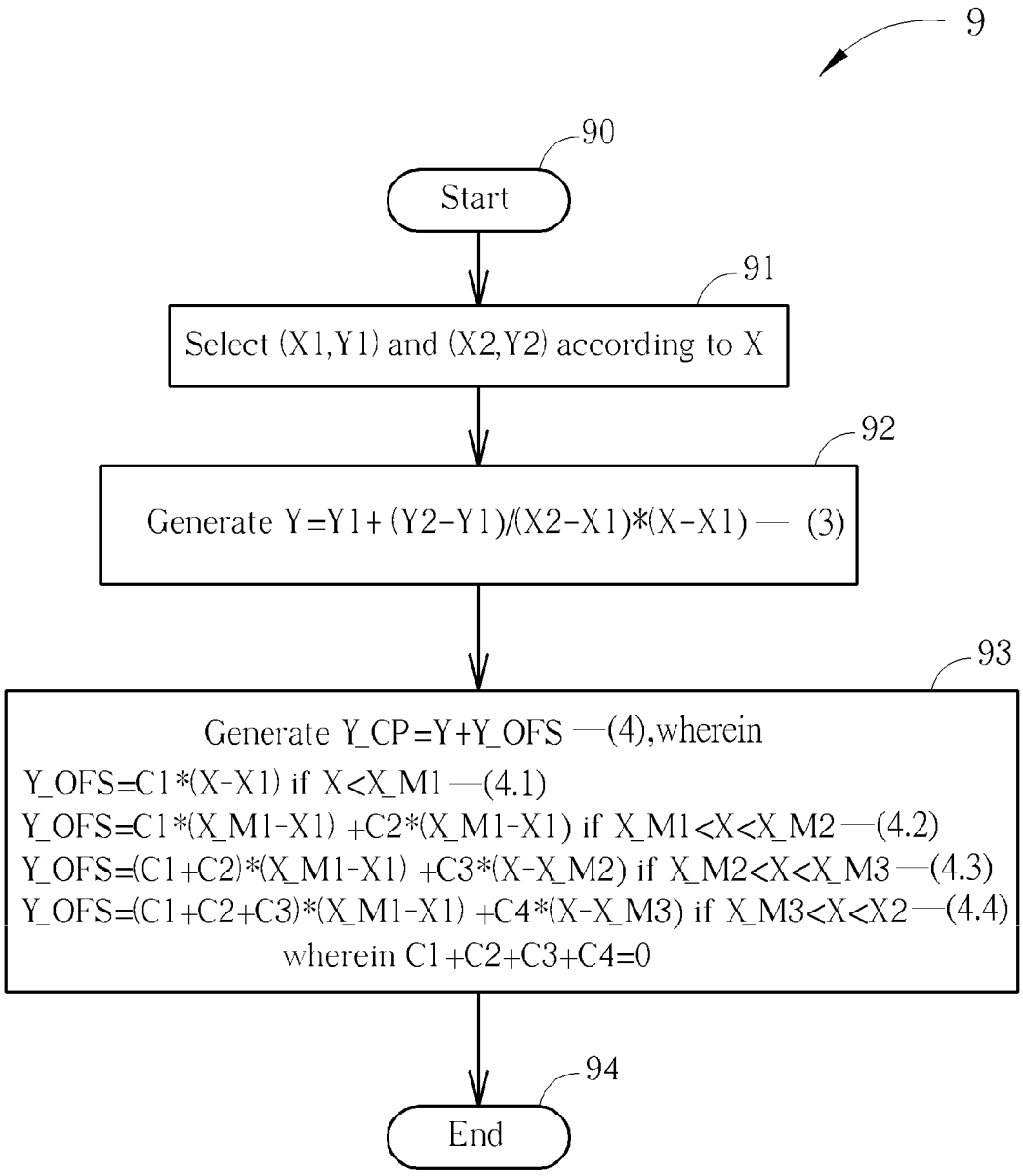
FIG. 9 is a schematic diagram of a process according to the second embodiment of the present invention.

Specifically, please refer to FIG. 8 and FIG. 9 at the same time. FIG. 9 illustrates a flowchart of a process 9 for mapping the input grayscale X into the corresponding compensated luminance Y_CP according to the second embodiment of the present invention. The process 9 describes a mapping scheme of the logic device 70 and includes the following steps:

Step 90: Start.

Step 91: Select the pinch points (X1,Y1) and (X2,Y2) according to the input grayscale X.

Step 92: Generate the output luminance Y according to the pinch points (X1,Y1) and (X2,Y2) and the input grayscale X.

Step 93: Generate an offset luminance Y_OFS to generate the compensated luminance Y_CP, where in the offset luminance Y_OFS is generated according to the input grayscale X, at least one middle reference grayscales and at least one slope compensating values.

Step 94: End.

In Step 91, the logic unit 74 selects the nearby pinch points (X1,Y1) and (X2,Y2) according to the input grayscale X from the lookup table unit 72, wherein the input grayscale X lies within the interval between the reference grayscales X1 and X2. Please note that the two nearby pinch points (X1,Y1) and (X2,Y2) selected by the logic unit 74 may be representative of any two nearby pinch points (X2,Y2) and (X3,Y3) or (X3, Y3) and (X4,Y4) if the input grayscale X lies within the interval between the two nearby reference grayscales X2 and X3 or the interval between the two nearby reference grayscales X3 and X4, respectively.

In Step 92, the logic unit 74 generates the output luminance Y according to the pinch points (X1,Y1) and (X2,Y2) and the input grayscale X by computing the equation (3).

In Step 93, the compensating unit 76 generates the compensated luminance Y_CP according to the output luminance Y, at least one slope compensating values C1, C2, C3, and/or C4 and the input grayscale X, wherein the compensated luminance Y_CP is generated by computing an equation (4) as follows:

$$Y_CP=Y+Y_\mathrm{OFS} \tag{4}$$

Wherein, Y_OFS denotes the offset luminance.

The compensating unit 76 generates the offset luminance Y_OFS by computing one of the following equations (4.1) to (4.4):

$$\text{If } X<X_M1,\ Y_OFS=C1*(X-X1) \tag{4.1}$$

$$\text{If } X_M1<X<X_M2,\ Y_\mathrm{OFS}=C1*(X_\mathrm{M1}-X1)+C2*(X-X_M1) \tag{4.2}$$

$$\text{If } X_\mathrm{M2}<X<X_M3,\ Y_\mathrm{OFS}=(C1+C2)*(X_\mathrm{M1}-X1)+C3*(X-X_M2) \tag{4.3}$$

$$\text{If } X_\mathrm{M3}<X<X2,\ Y_\mathrm{OFS}=(C1+C2+C3)*(X_M1-X1)+C4*(X-X_M3) \tag{4.4}$$

In detail, for the sub-segment within the interval between the reference grayscale X1 and the middle reference grayscal X_M1, the equation (4.1) is derived from a linear equation (5.1) as follows:

$$Y_\mathrm{CP}=Y1+[(Y2-Y1)/(X-X1)+C1]*(X-X1)=Y1+(M1+C1)*(X-X1) \tag{5.1}$$

Wherein, the slope M1 is denoted by (Y2−Y1)/(X−X1), a slope of the linear equation (5.1) is denoted by (M1+C1), and the equation (5.1) can be rewritten as follows:

$$Y_\mathrm{CP}=Y1+M1*(X-X1)+C1*(X-X1)=\text{equation (3)}+\text{equation (4.1)}$$

For the sub-segment within the interval between the middle reference grayscales X_M1 and X_M2, the equation (4.2) is derived from a linear equation (5.2) as follows:

$$\begin{aligned}\mathrm{Y_CP} &= Y1+(M1+C1)*(\mathrm{X_M1}-X1)+(M1+C2)*(\mathrm{X_M1}-X1)+C2*(X-\mathrm{X_M1}) \\ &= Y1+M1*(X-X1)+C1*(\mathrm{X_M1}-X1)+C2*(X-\mathrm{X_M1}) \\ &= \text{equation (3)}+\text{equation (4.2)}\end{aligned} \tag{5.2}$$

-continued

For the sub-segment within the interval between the middle reference grayscales X_M2 and X_M3, the equation (4.3) is derived from a linear equation (5.3) as follows:

$$\begin{aligned}\mathrm{Y_CP} &= Y1+(M1+C1)*(\mathrm{X_M2}-\mathrm{X_M1})+(M1+C2)*(\mathrm{X_M1}-X1)+(M1+C3)*(X-\mathrm{X_M2}) \\ &= Y1+M1*(X-X1)+C1*(\mathrm{X_M2}-\mathrm{X_M1})+C2*(\mathrm{X_M1}-X1)+C3*(X-\mathrm{X_M2})\end{aligned} \tag{5.3}$$

Noticeably, since the segment is equally divided by the middle reference grayscales X_M1, X_M2 and X_M3, a difference between any nearby reference grayscales is the same, i.e. (X_M2−X_M1) is equal to (X_M1−X1). Therefore, the equation (5.3) can be rewritten as follows:

$$\begin{aligned}\mathrm{Y_CP} &= Y1+M1*(X-X1)+(C1+C2)*(\mathrm{X_M1}-X1)+C3*(X-\mathrm{X_M1}) \\ &= \text{equation (3)}+\text{equation (4.3)}\end{aligned} \tag{5.31}$$

Likewise, for the sub-segment within the interval between the middle reference grayscale X_M3 and the reference grayscale X2, the equation (4.4) is derived from a linear equation (5.4) as follows:

$$Y_\mathrm{CP}=Y1+(M1+C1)*(X_M3-X_M2)+(M1+C2)*(X_M2-X_\mathrm{M1})+(M1+C3)*(X_M1-X1)+(M1+C4)*(X-X_M3) \tag{5.4}$$

$$=Y1+M1*(X-X1)+(C1+C2+C3)*(X_M1-X1)+C4*(X-X_M3)=\text{equation (3)}+\text{equation} \tag{4.4}$$

Wherein, (X_M3−X_M2) is equal to (X_M2−X_M1) or (X_M1−X1).

In short, the logic device 70 of the present invention is capable of compensating the output luminance Y to generate the compensated luminance Y_CP, which reduces the approximation error when using the linear transformation equation (3) to approximate the gamma curve and avoids unsmooth grayscale representation as well, wherein the offset luminance Y_OFS is generated according to in which sub-segments the input grayscale X lies. Moreover, due to the middle reference grayscales X_M1, X_M2 and X_M3 equally divide the interval between the reference grayscale X1 and X2, and the differences between any two of the reference grayscales X1 and X2 and the middle reference grayscales X_M1, X_M2 and X_M3 are divisible by two, the circuit design of the compensating unit 76 can be simplified to perform the required computations.

Figure 10:
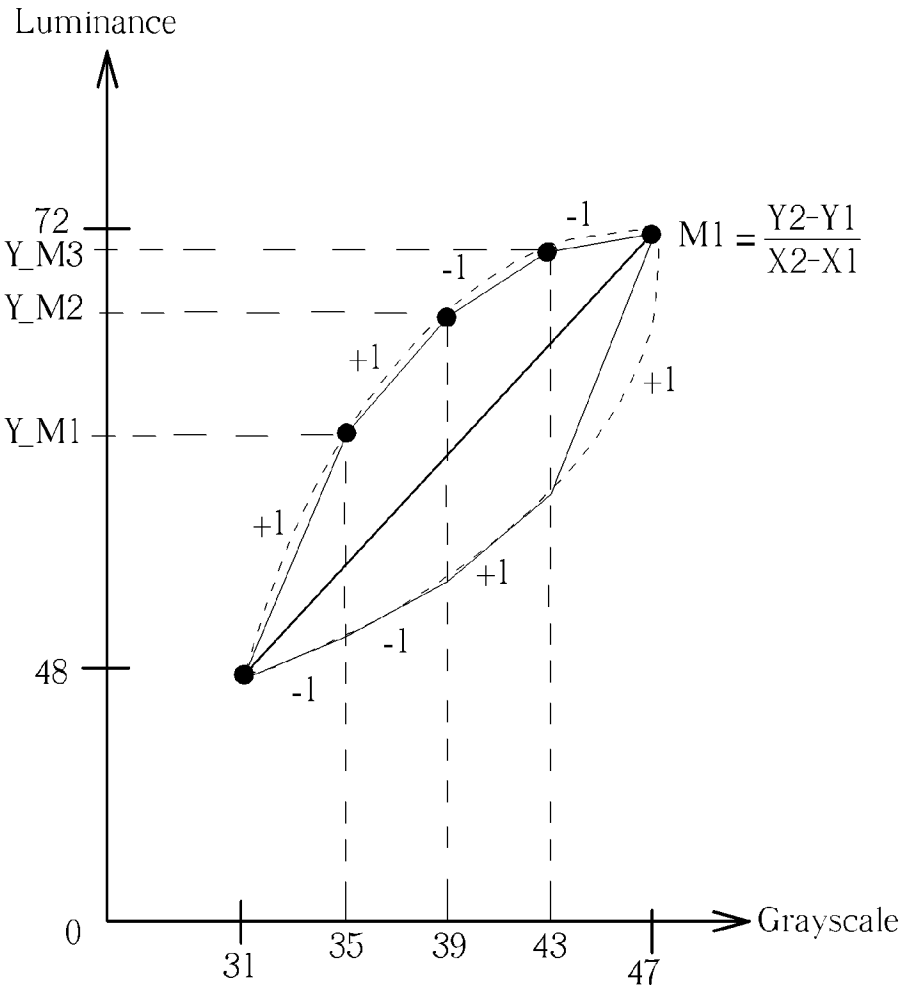
FIG. 10 illustrates a numerical example of the segment shown in FIG. 8.

Please refer to FIG. 10, which illustrates a numerical example of the segment shown in FIG. 8. In FIG. 10, it is assumed that the middle reference grayscales X_M1, X_M2 and X_M3 are 35, 39, 43, respectively; the input grayscale (X=37) lies within the interval between the reference grayscale (X1=31) and the reference grayscale (X2=47), and the input grayscale (X=37) also lies within the middle reference grayscales (X_M2=35) and (X_M3=39). In such a situation, the segment between the reference grayscales (X1=31) to (X2=47) is equally divided by four sub-segments with 2-bit distance, i.e. differences between any nearby grayscales are four. The slope compensating values C1, C2, C3, and C4 are assumed to be 1, 1, −1, and −1, respectively.

The logic device 70 generates the compensated luminance Y_CP by computing the equations (3) and (4.3), and the compensated luminance Y_CP is generated by:

$$Y_CP=48+(72-48)/(47-31)*(37-31)+(1+1)*(35-31)+(-1)*(37-39)=67$$

To sum up, the present invention provides two mapping schemes for mapping the input grayscale into the corresponding output luminance. One of the mapping schemes is to automatically and iteratively generate extra pinch points between any two nearby pinch points when unsmooth grayscale representation is detected, such that the variation between the extra pinch point and the pinch points, or any two nearby points, is ensured to be small enough to avoid unsmooth grayscale representation. The other mapping scheme is to compensate the output luminance to generate the compensated luminance, which reduces the approximation error when using the linear transformation equation to approximate the gamma curve and avoids unsmooth grayscale representation as well.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for mapping an input grayscale into an output luminance comprising:

selecting a first reference grayscale, a first reference luminance, a second reference grayscale and a second reference luminance according to an input grayscale;

generating a middle reference grayscale and a middle luminance by computing first and second equations of:

$$X_MID=(X1+X2)/2;\text{ and}$$

$$Y_MID=(Y1+Y2)/2\pm\Delta,$$

wherein Δ denotes an offset, X1 denotes the first reference grayscale, X2 denotes the second reference grayscale, Y1 denotes the first reference luminance, Y2 denotes the second reference luminance, X_MID denotes the middle reference grayscale, and the Y_MID denotes the middle luminance;

replacing a value of the first or second reference grayscale by a value of the middle reference grayscale, and replacing a value of the first or second reference luminance by a value of the middle luminance according to the middle reference grayscale and the input grayscale; and generating an output luminance by computing a third equation of:

$$Y=Y1+(Y2-Y1)/(X2-X1)*(X-X1),\text{ wherein } Y \text{ denotes the output luminance.}$$

2. The method of claim 1, wherein the value of the first reference grayscale is replaced by the value of the middle reference grayscale and the value of the first reference luminance is replaced by the value of the middle luminance if the input grayscale is greater than the middle reference grayscale; and the value of the second reference grayscale is replaced by the value of the middle reference grayscale and the value of the second reference luminance is replaced by the value of the middle luminance if the input grayscale is smaller than the middle reference grayscale.

3. The method of claim 1, further comprising:

generating a first slope according to the first reference grayscale, the first reference luminance, the middle reference grayscale and the middle luminance, and generating a second slope according to the second reference grayscale, the second reference luminance, the middle reference grayscale and the middle luminance; and generating another middle reference grayscale and another middle luminance by computing the first and second equations if an absolute difference between the first and second slopes is greater than a threshold value.

4. A device for mapping an input grayscale into an output luminance comprising:

a lookup table unit, for storing a plurality of reference grayscales corresponding to a plurality of reference luminance, respectively; and a logic unit, coupled to the lookup table unit, for selecting a first reference grayscale, a first reference luminance, a second reference grayscale and a second reference luminance according to an input grayscale to generate a middle reference grayscale and a middle luminance by computing first and second equations of:

$$X_MID=(X1+X2)/2;\text{ and}$$

$$Y_MID=(Y1+Y2)/2\pm\Delta,$$

wherein Δ denotes an offset, X1 denotes the first reference grayscale, X2 denotes the second reference grayscale, Y1 denotes the first reference luminance, Y2 denotes the second reference luminance, X_MID denotes the middle reference grayscale, and the Y_MID denotes the middle luminance;

replacing a value of the first or second reference grayscale by a value of the middle reference grayscale; and replacing a value of the first or second reference luminance by a value of the middle luminance according to the middle reference grayscale and the input grayscale to generate an output luminance by computing a third equation of:

$$Y=Y1+(Y2-Y1)/(X2-X1)*(X-X1),\text{ wherein } Y \text{ denotes the output luminance.}$$

5. The device of claim 4, wherein the value of the first reference grayscale is replaced by the value of the middle reference grayscale and the value of the first reference luminance is replaced by the value of the middle luminance if the input grayscale is greater than the middle reference grayscale; and the value of the second reference grayscale is replaced by the value of the middle reference grayscale and the value of the second reference luminance is replaced by the value of the middle luminance if the input grayscale is smaller than the middle reference grayscale.

6. The method of claim 4, wherein the logic device further generates a first slope according to the first reference grayscale, the first reference luminance, the middle reference grayscale and the middle luminance, and generates a second slope according to the second reference grayscale, the second reference luminance, the middle reference grayscale and the middle luminance; and generates another middle reference grayscale and another middle luminance by computing the first and second equations if an absolute difference between the first and second slopes is greater than a threshold value.

7. A method for mapping an input grayscale into an output luminance comprising:

selecting a first reference grayscale, a first reference luminance, a second reference grayscale and a second reference luminance according to an input grayscale; and generating an output luminance by computing a first equation of:

$$Y=Y1+(Y2-Y1)/(X2-X1)*(X-X1),$$

wherein Y denotes the output luminance, X1 denotes the first reference grayscale, X2 denotes the second reference grayscale, Y1 denotes the first reference luminance, Y2 denotes the second reference luminance, X_MID denotes the middle reference grayscale, and the Y_MID denotes the middle luminance; and generating a compensated luminance according to the output luminance, at least one slope compensating values, and the input grayscale, wherein the compensated luminance is generated by computing a second equation of:

$Y_CP=Y+Y_OFS$, wherein $Y_CP$ denotes the compensated luminance, and $Y_OFS$ denotes an offset luminance.

8. The method of claim 7, wherein the at least one slope compensating values comprises a first to fourth slope compensating values, and a sum of the first to fourth slope compensating values is equal to zero.

9. The method of claim 8, wherein generating the compensated luminance according to the output luminance, the at least one slope compensating values, and the input grayscale comprises:

generating at least one middle reference grayscales according to the input grayscale; and generating the offset luminance according to the input grayscale, the at least one slope compensating values, and the at least one slope compensating values.

10. The method of claim 9, wherein the at least one middle reference grayscales comprises a first to third middle reference grayscales, an interval between the first reference grayscale and the second reference grayscale is equally divided by the first to third middle reference grayscales, and differences between any two of the first and second reference grayscales, and the first to third middle reference grayscales are divisible by two.

11. The method of claim 10, wherein the offset luminance is generated by computing an equation of:

$$Y_OFS=C1*(X-X1),$$

wherein the input grayscale is smaller than the first reference grayscale.

12. The method of claim 9, wherein the offset luminance is generated by computing an equation of:

$$Y_OFS=C1*(X_M1-X1)+C2*(X-X_M1),$$

wherein the input grayscale is greater than the first middle reference grayscale and smaller than the second middle reference grayscale.

13. The method of claim 9, wherein the offset luminance is generated by computing an equation of:

$$Y_OFS=(C1+C2)*(X_M1-X1)+C3*(X-X_M2),$$

wherein the input grayscale is greater than the second middle reference grayscale and smaller than the third middle reference grayscale.

14. The method of claim 9, wherein the offset luminance is generated by computing an equation of:

$$Y_OFS=(C1+C2+C3)*(X_M1-X1)+C4*(X-X_M3),$$

wherein the input grayscale is greater than the third middle reference grayscale and smaller than the second reference grayscale.

15. A device for mapping an input grayscale into an output luminance comprising:

a lookup table unit, for storing a plurality of reference grayscales corresponding to a plurality of reference luminance, and a plurality of slope compensating values;

a logic unit, coupled to the lookup table unit for selecting a first reference grayscale, a first reference luminance, a second reference grayscale and a second reference luminance according to an input grayscale to generate an output luminance by computing a first equation of:

$$Y=Y1+(Y2-Y1)/(X2-X1)*(X-X1),$$

wherein Y denotes the output luminance, X1 denotes the first reference grayscale, X2 denotes the second reference grayscale, Y1 denotes the first reference luminance, Y2 denotes the second reference luminance, X_MID denotes the middle reference grayscale, and the Y_MID denotes the middle luminance; and a compensating unit, coupled to the logic unit and the lookup table unit, for generating a compensated luminance according to the output luminance, at least one slope compensating values, and the input grayscale, wherein the compensated luminance is generated by computing a second equation of:

$Y_CP=Y+Y_OFS$, wherein $Y_CP$ denotes the compensated luminance, and $Y_OFS$ denotes an offset luminance.

16. The device of claim 15, wherein the at least one slope compensating values comprises a first to fourth slope compensating values, and a sum of the first to fourth slope compensating values is equal to zero.

17. The device of claim 16, wherein the compensating unit generates at least one middle reference grayscales according to the input grayscale to generate the offset luminance according to the input grayscale, the at least one slope compensating values, and the at least one slope compensating values.

18. The device of claim 17, wherein the at least one middle reference grayscales comprises a first to third middle reference grayscales, an interval between the first reference grayscale and the second reference grayscale is equally divided by the first to third middle reference grayscales, and differences between any two of the first and second reference grayscales, and the first to third middle reference grayscales are divisible by two.

19. The device of claim 17, wherein the compensating unit generates the offset luminance by computing an equation of:

$Y_OFS=C1*(X-X1)$, wherein the input grayscale is smaller than the first reference grayscale.

20. The device of claim 17, wherein the compensating unit generates the offset luminance by computing an equation of:

$$Y_OFS=C1*(X_M1-X1)+C2*(X-X_M1),$$

wherein the input grayscale is greater than the first middle reference grayscale and smaller than the second middle reference grayscale.

21. The device of claim 17, wherein the compensating unit generates the offset luminance by computing an equation of:

$$Y_OFS=(C1+C2)*(X_M1-X1)+C3*(X-X_M2),$$

wherein the input grayscale is greater than the second middle reference grayscale and smaller than the third middle reference grayscale.

22. The device of claim 17, wherein the compensating unit generates the offset luminance by computing an equation of:

$$Y_OFS=(C1+C2+C3)*(X_M1-X1)+C4*(X-X_M3),$$

wherein the input grayscale is greater than the third middle reference grayscale and smaller than the second reference grayscale.

* * * * *